United States Patent [19]

Perrine, Sr.

[11] 4,054,288

[45] Oct. 18, 1977

[54] FOAM PLASTIC ARCHERY TARGET WITH INTERNAL FRAME

[76] Inventor: Ronald E. Perrine, Sr., 3995 Navajo Trail, Jamestown, Ohio 45335

[21] Appl. No.: 703,076

[22] Filed: July 6, 1976

[51] Int. Cl.[2] ..... F41J 3/00; F41J 1/10

[52] U.S. Cl. ..... 273/102 S; 273/102 B

[58] Field of Search .....273/102 B, 102 S, 102 R, 102 AF, 273/102 PM; D34/5 PP, 15 ZZ

[56] References Cited

U.S. PATENT DOCUMENTS

| | | | |
|---|---|---|---|
| 2,818,259 | 12/1957 | Arenson | 273/102 B |
| 2,958,500 | 11/1960 | Saunders | 273/102 B |
| 3,109,618 | 11/1963 | Saunders | 273/102 B |
| 3,163,418 | 12/1964 | Myers | 273/102 B |
| 3,195,898 | 7/1965 | Respini | 273/102 S |
| 3,729,197 | 4/1973 | Swanson et al. | 273/102.2 R |

FOREIGN PATENT DOCUMENTS

| | | | |
|---|---|---|---|
| 123,082 | 7/1946 | Australia | 273/102 |

OTHER PUBLICATIONS

Advertisement of A.H. Delfausse Co., 1948, p.7.

*Primary Examiner*—Richard C. Pinkham
*Assistant Examiner*—Lawrence Everett Anderson
*Attorney, Agent, or Firm*—Clarence A. O'Brien & Harvey B. Jacobson

[57] ABSTRACT

An archery target having a backstop provided with markings representing a game animal, and the like, for forming a target area on the backstop. By constructing the backstop as a rectangular parallelepiped, markings can be provided on a pair of parallel faces in order to afford a choice of targets and to reduce wear on the backstop. The latter is enhanced by including in the markings designation of areas which are the primary target area in the animal, and by offsetting these designated areas from one another. The backstop is anchored at a desired location by a pair of rods extending through holes provided in the backstop and inserted into the ground or other support surface. An elastic element stretched between the rods above the backstop holds the backstop firmly in place relative to the internal frame formed by the rods.

3 Claims, 5 Drawing Figures

FOAM PLASTIC ARCHERY TARGET WITH INTERNAL FRAME

BACKGROUND OF THE INVENTION

1. Field of the Invention

This invention relates generally to archery, and particularly to an improved archery target suitable for use in simulated bow hunting as well as for general target practice.

2. Description of the Prior Art

It is desirable to have life size animal targets set in natural settings for the purpose of simulating bow hunts. In practice, however, it is difficult to set up such targets without a great deal of work, and further the known targets used for this purpose result in a great number of lost and damaged arrows, with a resulting loss of time and resulting expense. The target conventionally used today has to be staked, wired, or tied at each end, both front and back, which is very time-consuming and a lot of extra work.

U.S. Pat. No. 3,163,418, issued Dec. 29, 1964 to W. R. Myers, discloses a simulated animal target for archers which comprises a stuffed target simulating the body and head of an animal and mounted on a pair of stakes driven into the ground. While this animal target overcomes many of the disadvantages of the targets conventionally employed, it does not contemplate the use of a backstop in order to prevent errant arrows from becoming lost.

Other prior patents which exemplify the state of the art as regards archery targets are:

U.S. Pat. No. 1,837,627, 12/22/31; 3,048,401, 8/ 7/62; 3,367,660, 2/ 6/68; 3,476,390, 11/ 4/69.

SUMMARY OF THE INVENTION

It is an object of the present invention to provide an archery target which includes a backstop which will stop errant arrows while still meeting basic safety requirements for such targets.

It is another object of the present invention to provide an archery target having a backstop large enough to stop virtually all high and wide shot arrows and prevent these arrows from becoming lost and/or damaged.

It is yet another object of the present invention to provide an archery target having high wear resistance as well as good resistance to arrow penetration, so as to prevent an arrow from passing through the target, and which provides for changing the nature of the target in a quick and simple manner.

It is still another object of the present invention to provide an animal archery target which is life-like, life size, convenient to set up, will hold up in any weather, and is easy to handle and store when not in use.

Still other objects of the present invention include the provision of an archery target which facilitates training of bow hunters so as to permit the hunters to see an animal as it would actually appear in nature as regards size, shape, and natural setting, all of this accomplished with a minimum of work in the field; to provide a target which is free of wires, and the like, near the surface thereof that could cause deflection of and damage to an arrow tip; and to provide a target on which all arrows can be seen clearly, to the hit, so as to easily score an arrow.

These and other objects of the present invention are achieved by providing an archery target having: a backstop provided with markings forming a target area; and an anchor engaging the backstop for releasably retaining the backstop at a predetermined location. The backstop is in the form of a rectangular parallelepiped constructed from a foam material, and the like, and provided with a through hole. The anchor includes a rod disposed in the hole provided in the parallelpiped and insertable into a support surface, such as the ground, on which the backstop is arranged for retaining the backstop as desired.

According to a particularly advantageous feature of the present invention, the parallelepiped is provided with a pair of spaced, parallel through holes, and the anchor includes a pair of rods disposed in the holes and inserted into the ground or other support surface. The rods are also each preferably provided wth a crossbar aranged adjacent the lower, or ground insertable, end thereof so as to form a step for facilitating insertion of the rod into the ground. The parallelepiped will rest on the crossbars of the rods, and will be retained on the rods as by an elastic element connected to the rods at points thereof above the backstop, so as to arrange the backstop between the elastic element and the crossbars, with the elastic element drawing the upper ends of the rods toward one another in order to prevent upward movement of the backstop relative to the rods.

The markings of the backstop are preferably provided on parallel faces of the parallelepiped and are in the form of likenesses of game animals such as deer. Each set of the markings includes a designation of a target area in which the animal would be killed by a projectile such as an arrow, with the target area on each of the faces of the parallelepiped being offset from the other target area for reducing wear of the backstop by having the arrows striking, in at least their largest concentration, different portions of the backstop as each face of the parallelepiped is oriented for use as a target.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
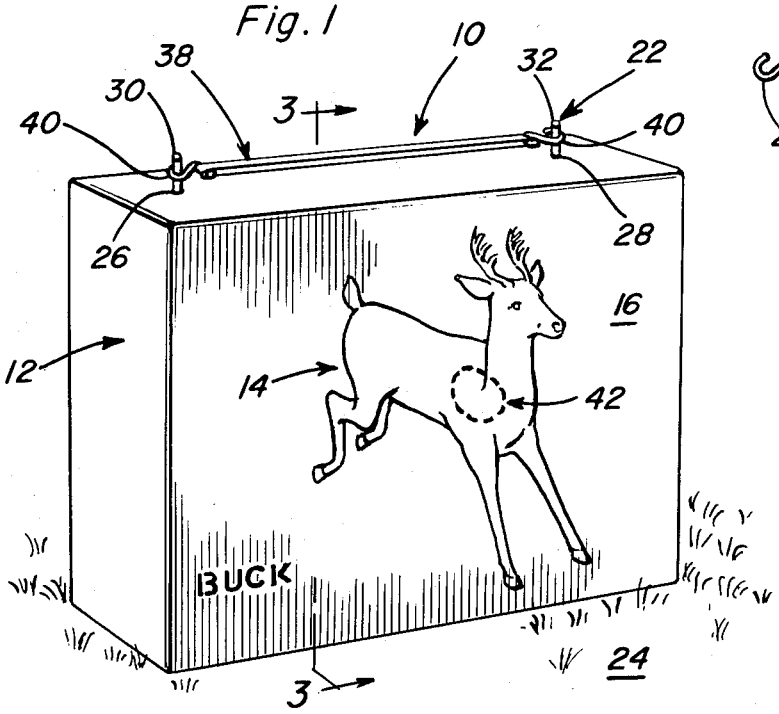
FIG. 1 is a perspective view showing an archery target according to the present invention.
Figure 5:
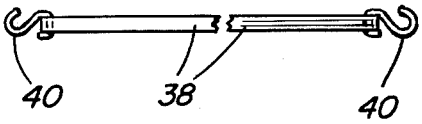
FIG. 5 is a fragmentary, plan view showing an elastic member forming another part of the anchor frame for the archery target according to the present invention.
Figure 4:
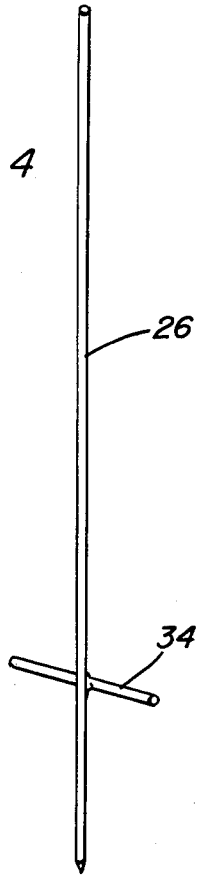
FIG. 4 is a perspective view of a rod forming part of an anchor frame for the archery target according to the present invention.
Figure 2:
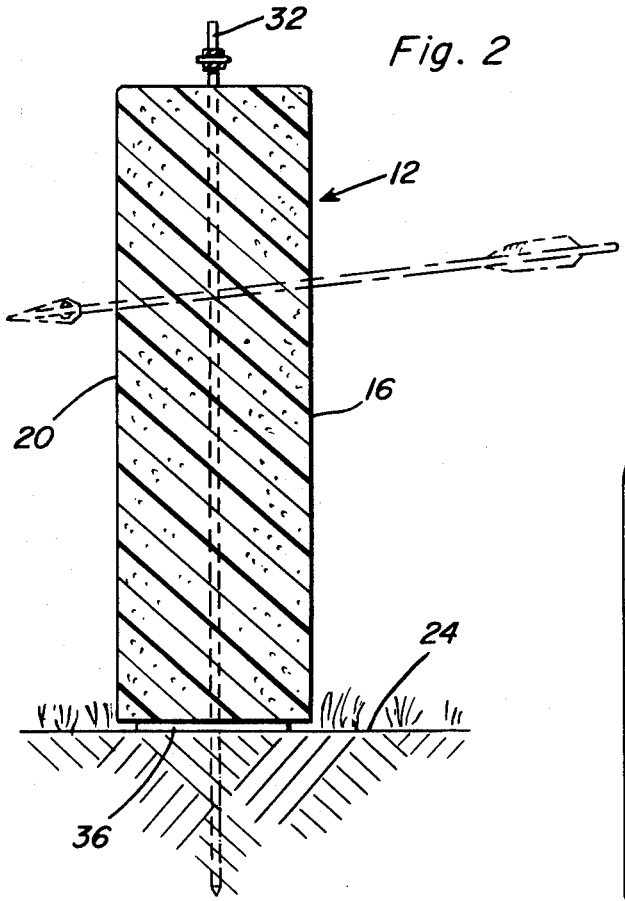
FIG. 2 is a perspective view showing the rear surface or face of the backstop portion of the target shown in FIG. 1.
Figure 3:
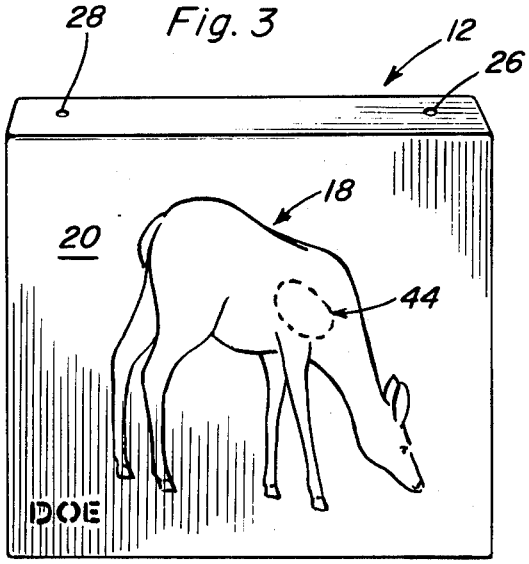
FIG. 3 is an enlarged sectional view taken generally along the line 3—3 of FIG. 1.

Now referring more particularly to the drawings, an archery target 10 according to the invention includes a backstop 12 provided with markings 14 on a first face 16 for forming a first target area, and markings 18 provided on a second face 20 for forming a second target area. As can be appreciated, face 16 or face 20 can be arranged in proper position for use as a target simply by rotating backstop 12 180° on an anchor arrangement 22 arranged for engaging the backstop 12 in order to releasably retain the backstop 12 at a predetermined location on a support surface 24, which will usually be a piece of ground.

Backstop 12 is advantageously in the form of the illustated rectangular parallelepiped, and advantageously is constructed from a suitable foam material, such as polyurethane. This parallelepiped is provided with a pair of through holes 26 and 28 disposed substantially parallel to one another and extending parallel to the planes of the faces 16 and 20. Disposed in these holes 26 and 28 are a pair of rods 30 and 32 insertable into support surface 24 on which backstop 12 is arranged for anchoring backstop 12 to the support surface 24.

Rods 30 and 32 are each provided with a crossbar 34 and 36 arranged forming a step for facilitating insertion of the associated rod 30, 32 into support surface 24. The parallelepiped forming the backstop 12 rests on the crossbar 34, 36 of each of the rods 30, 32. The anchor arrangement 22 includes in addition to the rods 30, 32 an elastic element 38 attached to the rods 30, 32 as by the S-shaped hooks 40 and is arranged extending between the rods 30, 32 at a point above the backstop 12 so that the backstop 12 is arranged between the elastic element 28 and the crossbars 34, 36 for biasing the upper ends of the rods 30, 32 toward one another in order to bias the parallelepiped downwardly toward the crossbars 34, 36. In this manner, the backstop 12 is securely retained on the anchor arrangement 22.

The markings 14 and 18 preferably form likenesses of game animals, such as the illustrated buck and doe, with each of the markings 14 and 18 including a designation 42 and 44, respectively, of a target area within the animal in which the animal would be killed by a projectile, such as an arrow. The target area of each of the designations 42 and 44 is provided on an associated one of the faces 16, 20 and is offset from the designation 44, 42 on the other of the faces 20, 16 in order to reduce wear of backstop 12 by having the biggest concentration of arrows striking one of the faces 16, 20 being at a different part of backstop 12 than the concentration of arrows striking the other of the faces 20, 16.

It is also possible to make the target area of the designations 42 and 44 a removable plug or core (not shown) which may be changed from time to time as same becomes worn due to repeated impingements by arrows.

As can be appreciated from the above description and from the drawings, an archery target according to the present invention permits the placement of animal targets at appropriate points in conjunction with a suitable backstop in a simple and easy manner, yet is sufficiently resistant to penetration of arrows for safety requirements.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An archery target comprising, in combination:

a. a backstop provided with markings forming a target area; and b. anchor means engaging the backstop for releasably retaining the backstop at a predetermined location, the backstop being in the form of a rectangular parallelepiped constructed from a foam material and provided with a pair of spaced, parallel through holes, with the anchor means including a pair of rods disposed in the holes and insertable into a support surface on which the backstop is arranged, said pair of rods disposed in said holes substantially perpendicular to the support surface, and the anchor means further including an elastic element detachably attached to and arranged extending between the rods, the parallelepiped arranged between the elastic element and the support surface, with the elastic element biasing the rods toward one another in order to bias the parallelpiped toward the support surface.

2. A structure as defined in claim 1, wherein the rods are each provided with a crossbar arranged forming a step for facilitating insertion of the rod into the support surface, with the parallelepiped resting on the crossbar of each of the rods, and the elastic element biasing the parallelepiped toward the crossbar of each of the rods.

3. A structure as defined in claim 2, wherein the markings are provided on a pair of parallel faces of the parallelepiped and form likenesses of game animals, with each of the markings including a designation of a target area in which the animal would be killed by a projectile, the target area on each of the faces being offset from the target area on the other of the faces for reducing wear of the backstop.

* * * * *